US010058187B2

(12) United States Patent
Gibson

(10) Patent No.: US 10,058,187 B2
(45) Date of Patent: Aug. 28, 2018

(54) FOLDING STEP STOOL

(71) Applicant: DOREL HOME FURNISHINGS, INC., Wright City, MO (US)

(72) Inventor: William R Gibson, Kent, OH (US)

(73) Assignee: Dorel Home Furnishings, Inc., Wright City, MO (US)

( * ) Notice: Subject to any disclaimer, the term of this patent is extended or adjusted under 35 U.S.C. 154(b) by 378 days.

(21) Appl. No.: 14/640,692

(22) Filed: Mar. 6, 2015

(65) Prior Publication Data

US 2015/0322717 A1 Nov. 12, 2015

Related U.S. Application Data

(60) Provisional application No. 61/989,344, filed on May 6, 2014.

(51) Int. Cl.
*E06C 1/30* (2006.01)
*A47C 12/00* (2006.01)

(52) U.S. Cl.
CPC ..... *A47C 12/00* (2013.01); *E06C 1/30* (2013.01)

(58) Field of Classification Search
CPC ..... A47C 13/00; E06C 1/30
See application file for complete search history.

(56) References Cited

U.S. PATENT DOCUMENTS 155,999 A * 10/1874 Valley ..... A47B 3/0912 108/131
290,932 A * 12/1883 Richardson ..... A47B 3/0815 108/133
1,133,109 A * 3/1915 Derbyshire ..... A47B 3/0912 108/132
3,805,711 A * 4/1974 Lakso ..... A47C 4/10 108/133
4,010,699 A * 3/1977 Lakso ..... A47C 4/10 108/133
4,129,346 A * 12/1978 Hofman ..... A45C 5/00 312/244
6,966,404 B2 11/2005 Meeker
8,875,840 B2 * 11/2014 Chancler ..... A47C 9/10 182/33

* cited by examiner

*Primary Examiner* — Alvin C Chin-Shue
(74) *Attorney, Agent, or Firm* — Barnes & Thornburg LLP

(57) ABSTRACT

A foldable step stool includes a step and a pair of legs. The legs are mounted on the step for movement between use and storage positions.

19 Claims, 12 Drawing Sheets

FOLDING STEP STOOL

PRIORITY CLAIM

This application claims priority under 35 U.S.C. § 119(e) to U.S. Provisional Application Ser. No. 61/989,344, filed May 6, 2014, which is expressly incorporated by reference herein.

BACKGROUND

The present disclosure relates to a step stool, and particularly to a folding step stool. More particularly, the present disclosure relates to a folding step stool having one step and legs configured such that they can be locked in an opened position by a locking mechanism.

SUMMARY

According to the present disclosure, a step stool includes a step, pivotable first and second legs, and a leg lock. In illustrative embodiments, the leg lock is configured to lock each of the first and second legs in a stationary position relative to the step once the legs are pivoted relative to the step from retracted to expanded positions to elevate the step above ground underlying the step and supporting the legs.

In illustrative embodiments, the first leg is coupled to a first end of the step for pivotable movement about a first-end leg pivot axis while the second leg is coupled to an opposite second end of the step for pivotable movement about a second-end leg pivot axis that is substantially parallel to the first-end leg pivot axis. The leg lock is mounted to the underside of the step for pivotable movement relative to the step about a leg-lock pivot axis that intersects and lies in substantially perpendicular relation to each of the first-end and second-end leg pivot axes.

In illustrative embodiments, the step stool includes a leg-rigidifier panel comprising the pivotable leg lock and a carry handle coupled to the leg lock to pivot therewith relative to the step. The carry handle is arranged to be gripped by a consumer when the legs are pivoted to assume the retracted positions alongside the step.

In illustrative embodiments, the leg lock is mounted for pivotable movement about the leg-lock pivot axis from a retracted position arranged to lie alongside the underside of the step to an expanded position arranged to lie in generally perpendicular relation to the step. In use, the legs are engaged by the pivoting leg lock and pivot about their respective pivot axes to move automatically from their retracted positions to their expanded positions in response to pivoting movement of the leg lock from its retracted position to its expanded position.

In illustrative embodiments each of the first and second legs is mounted for pivotable movement about their respective leg pivot axes between (1) retracted positions in which the legs are arranged to lie in end-to-end relation to one another and in generally spaced-apart parallel relation to the underside of the step to define a lock-receiver pocket therebetween and (2) expanded positions in which the legs are arranged to lie in generally perpendicular relation to the step. When the step stool has been folded by a user to assume a compact storage mode, the leg lock of the leg-rigidifier panel is retained in the lock-receiver pocket formed between the step and the retracted legs.

In illustrative embodiments, a free side edge of the pivotable leg lock is coupled to a carry handle to form the leg-rigidifier panel. The carry handle is arranged to extend out of the lock-receiver pocket defined between the step and the first and second legs in the compact storage mode of the step stool to provide an exposed handgrip for use by a consumer as the consumer carries the step stool in the compact storage mode as a briefcase would be carried.

In illustrative embodiments, a peripheral portion of each end edge of the pivotable leg lock is arranged to engage and slide along an inner wall of a neighboring leg during pivoting movement of the leg lock about the leg-pivot axis from the retracted position to the expanded position. During such pivoting movement of the leg lock, a peripheral portion of a first end-edge of the leg lock engages and moves along a first guide included in the first leg to cause the first leg to pivot about the first leg-pivot axis away from the second leg and move from its retracted position to its expanded position. Simultaneously, a peripheral portion of a second end-edge of the leg lock moves along a second guide included in the second leg to cause the second leg to pivot about the second leg-pivot axis away from the first leg and move from its retracted position to its expanded position so that the first and second legs are arranged to lie generally perpendicular to the step and parallel to one another to elevate the step when the step stool is unfolded by a consumer to assume an opened, use mode.

In illustrative embodiments, the leg lock is retained in its expanded position by means of a snap-fit engagement between the leg lock and a first retainer arm included in the first leg and a second retainer arm included in the second leg upon arrival of the pivoting leg lock at its expanded position. The first retainer arm is appended to the inner wall of an arm-support panel included in the first leg and arranged to overlie the underside of the step when and the step lays directly on a surface and the first leg is pivoted to its expanded position. When each of the first leg and leg lock are pivoted to assume their expanded positions, a lug provided on the first retainer arm snaps into a first lug-receiving notch formed on the free side edge of the leg lock near the carry handle to lock the first leg to the leg lock so that each of the first leg and the leg lock is retained in the expanded position. Similarly, the second retainer arm is appended to the inner wall of an arm-support panel included in the second leg and arranged to overlie the underside of the step when and the step lays directly on a surface and the second leg is pivoted to its expanded position. When each of the second leg and leg lock are pivoted to assume their expanded positions, a lug provided on the second retainer arm snaps into a second lug-receiving notch formed on the free side edge of the leg lock near the carry handle to lock the second leg to the leg lock so that each of the second leg and the leg lock is retained in the expanded position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
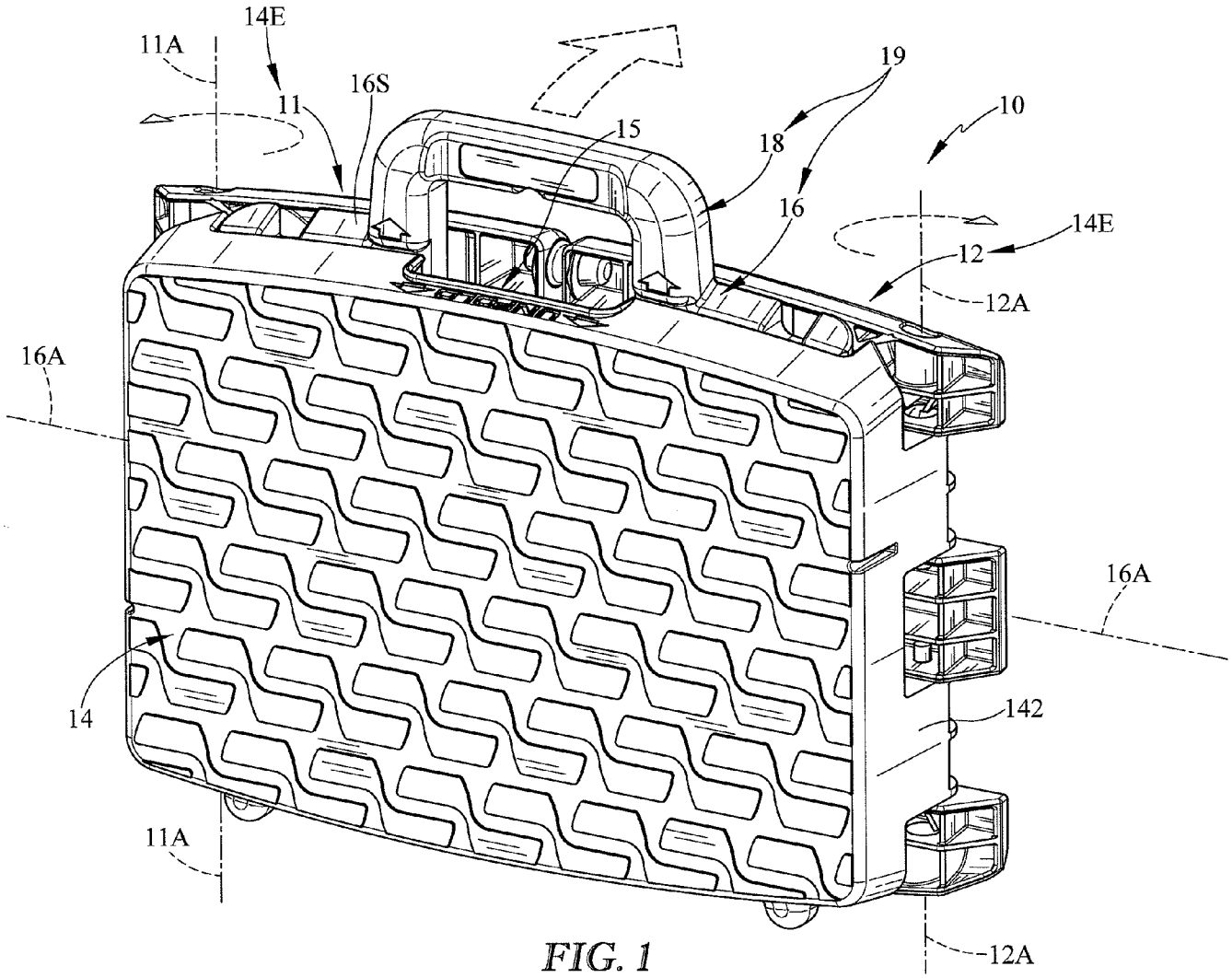
FIG. 1 is a perspective view of a step stool in accordance with the present disclosure showing step treads formed in a top side of a step included in the step stool and showing the step stool in a compact storage mode in which a carry handle included in a leg-rigidifier panel is arranged to extend upwardly above the step and folded first and second legs that are located behind the step to provide an exposed handgrip so that a user can grasp the exposed handgrip and carry the step stool as one would carry a briefcase.
Figure 2:
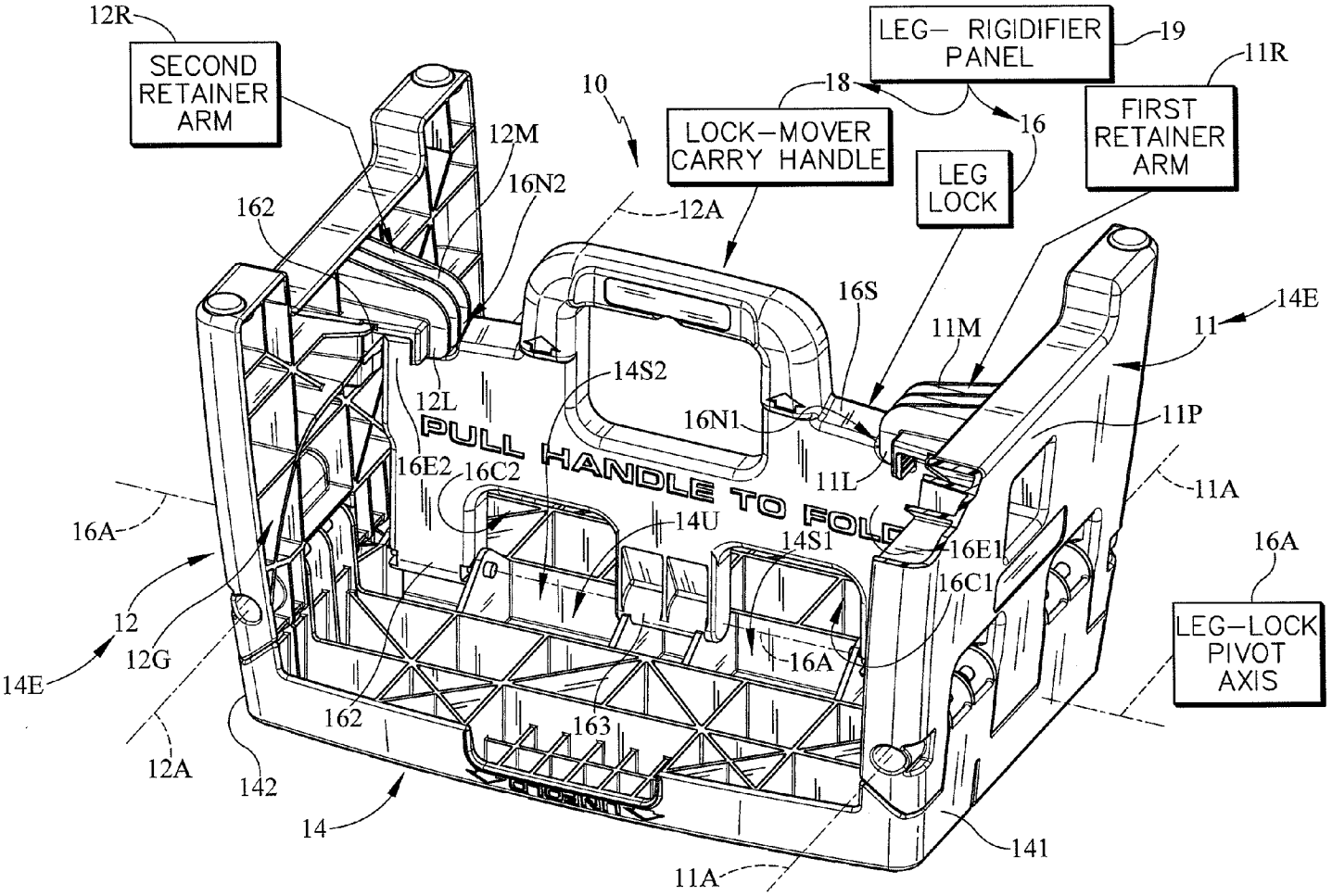
FIG. 2 is a perspective view of the step stool in an inverted orientation after it has been converted to an expanded use mode from the compact storage mode shown in FIG. 1 using, for example, an unfolding process shown in FIGS. 4-10 and showing that the leg-rigidifier panel is located above the underside of the step and between the first and second legs, and that a leg lock included in the leg-rigidifier panel is pivotably coupled to the underside of the step, and showing the leg lock in an expanded position and locked to first and second legs that have been moved relative to the underlying step to their expanded positions.
Figure 3:
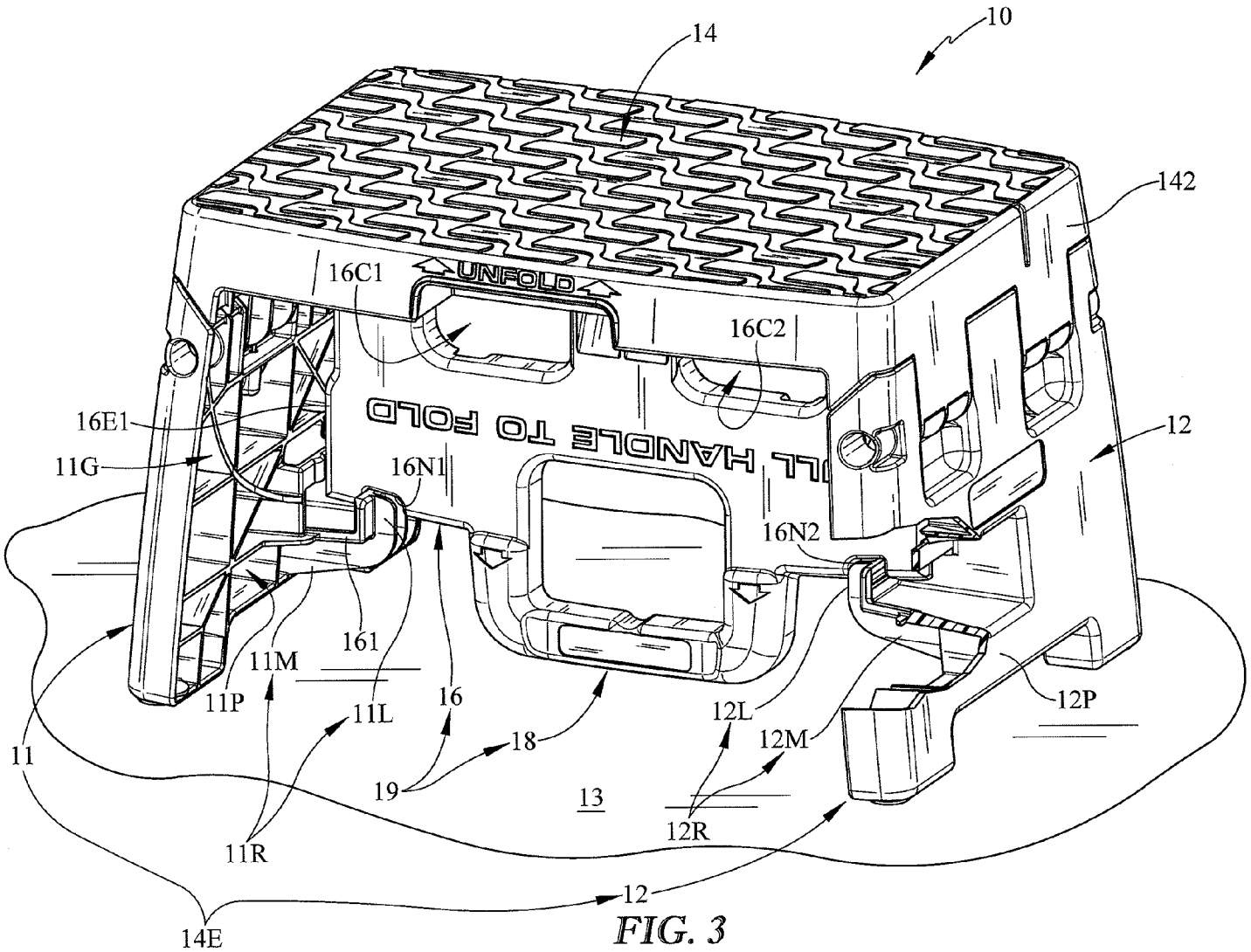
FIG. 3 is a view of the step stool of FIG. 2 in a right-side-up orientation with a portion of the second leg broken away to show engagement of the lug of the second retainer arm in a second lug-receiving notch formed in the leg lock and showing the leg lock spanning a space under the step and mating with opposing first and second legs, a curved first guide formed in the first leg and sized to mate with a slide member included in a left-end edge of the leg lock, a first retainer arm included in the first leg and arranged to extend toward the second leg and to engage a first lug-receiving notch formed in a downwardly facing free side edge of the leg lock, and a carry handle included in the leg lock and arranged to extend downwardly toward the ground underlying the step stool when the step stool is in the expanded use mode.
Figure 4:
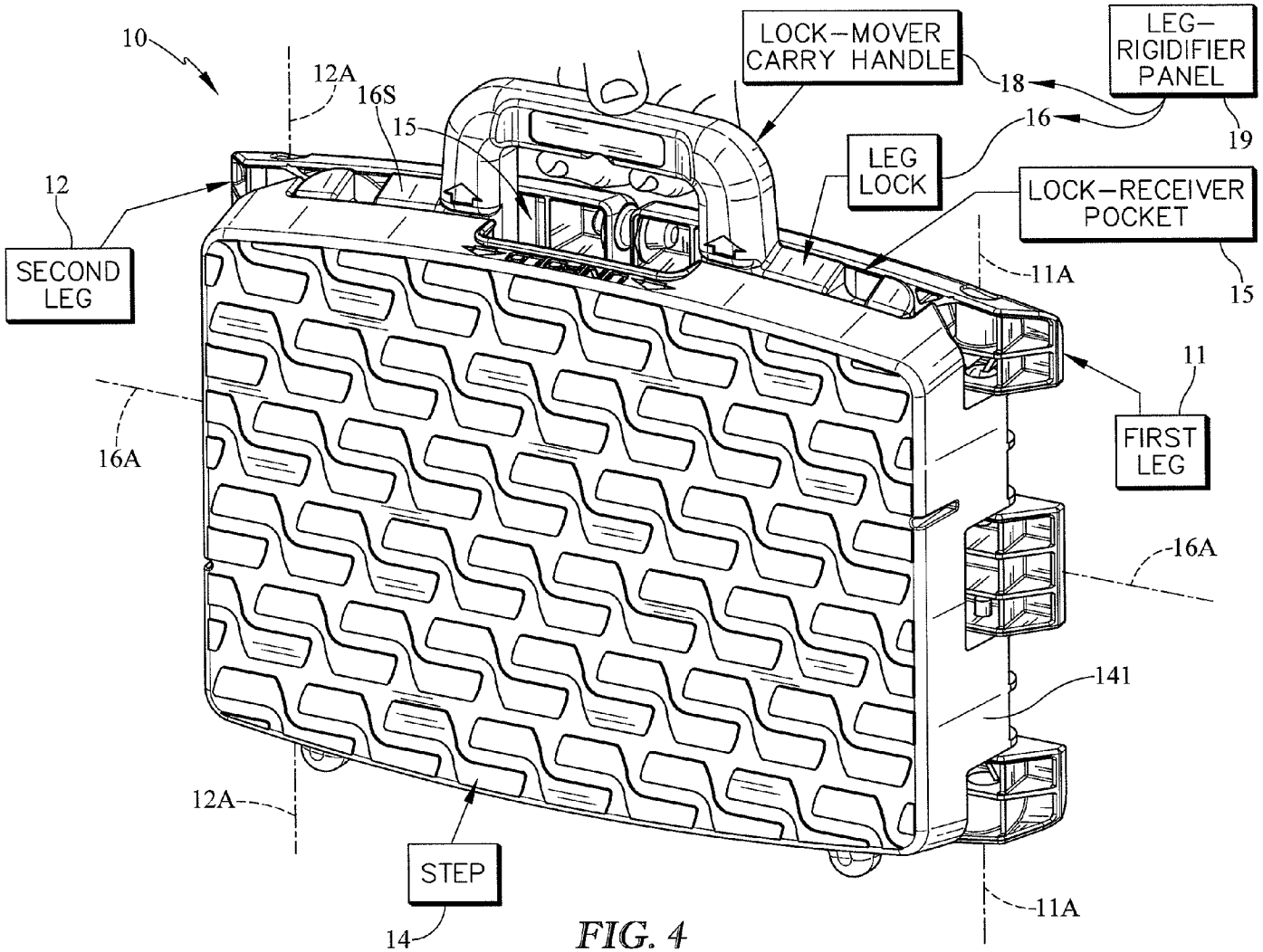
FIG. 4 is a view similar to FIG. 1 showing a consumer grasping the exposed handgrip included in the lock-mover carry handle of the leg-rigidifier panel while the step stool lies in a vertical brief case-like orientation in the compact storage mode and showing that the leg lock of the leg-rigidifier panel is positioned to lie in a lock-receiver pocket formed between the step and the two folded legs when the step stool is in the compact storage mode.
Figure 5:
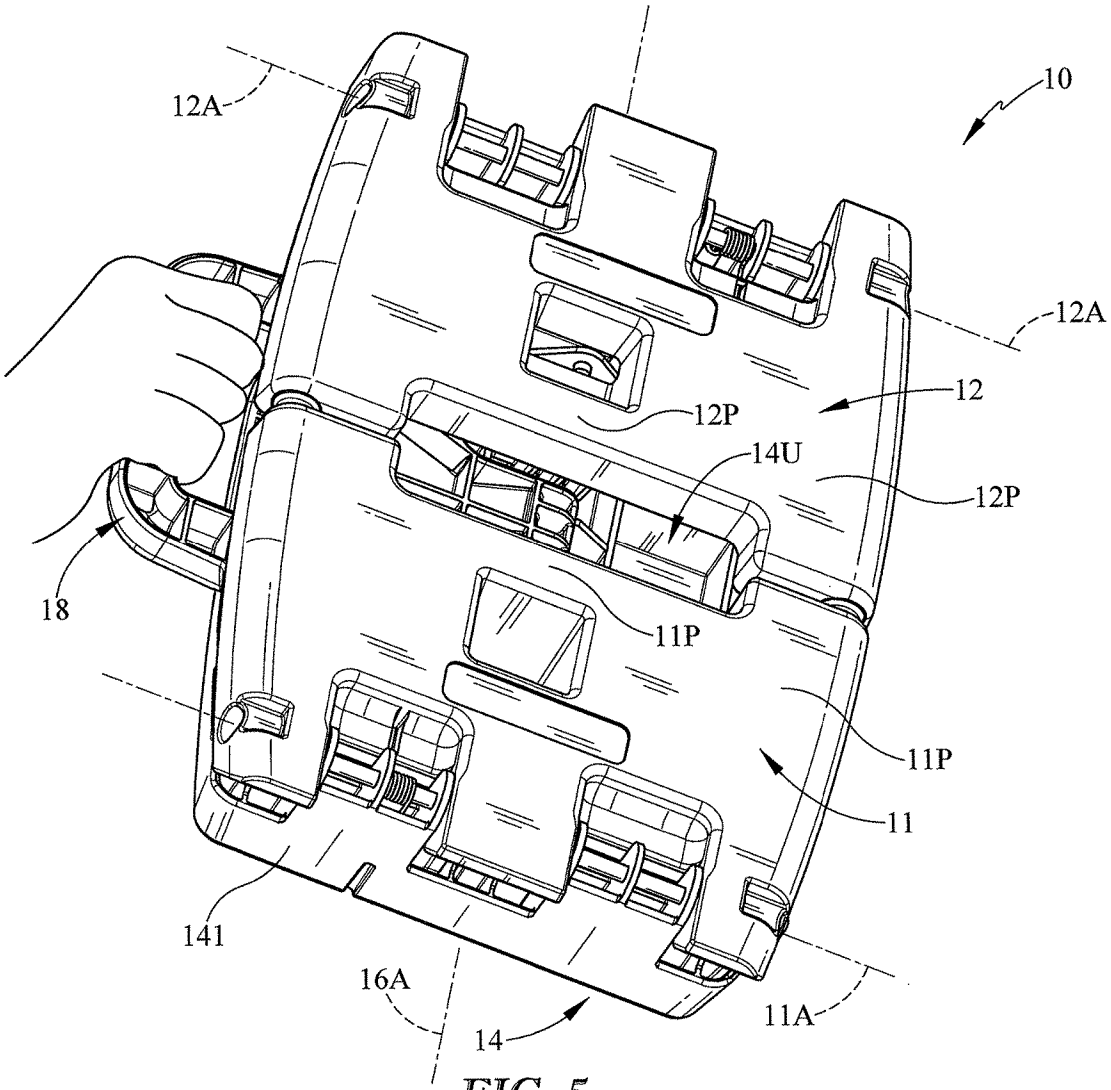
FIG. 5 is a view of the step stool of FIG. 1 showing the retracted position and end-to-end relationship of each of the first and second legs and of the leg lock when the steps stool is in the compact storage mode and showing that the leg lock of the leg-rigidifier panel is located in a lock-receiver pocket formed between the step and the first and second legs.
Figure 6:
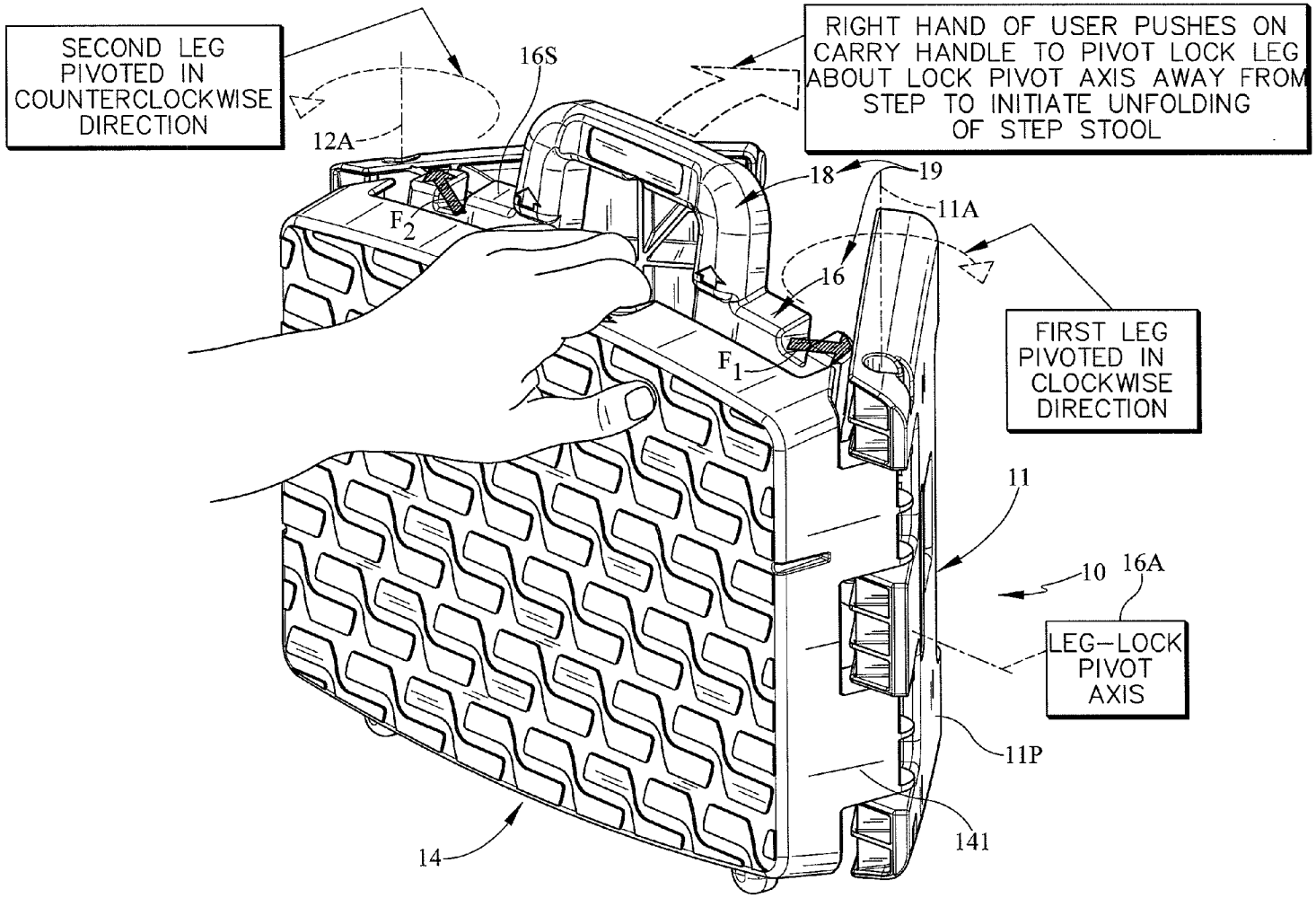
FIG. 6 shows that a consumer is using a left hand to hold the step in a steady position while a right hand diagrammatically grasps the carry handle and pivots the carry handle and the leg lock coupled to the carry handle about a leg-lock pivot axis to cause the leg lock to engage and move the first leg to pivot in a clockwise direction about a first leg-lock axis away from the second leg and to cause the leg lock to engage and move the second leg to pivot in a counterclockwise about a second leg-lock axis away from the first leg.

A step stool 10 in accordance with the present disclosure is unfoldable at the option of a user so that it can be changed from a compact storage mode shown in FIGS. 1, 4, and 5 to an expanded use mode shown in FIGS. 2 and 3 using, for example, an unfolding process shown in FIGS. 4-10. Step stool 10 includes first and second legs 11, 12 mounted for pivotable movement to a step 14 and a leg-rigidifier panel 19 including a leg lock 16 mounted for pivotable movement to step 14 and a lock-mover carry handle 18 coupled to leg lock 16 as suggested in FIG. 2. Legs 11, 12 cooperate to form a step elevator that functions to elevate step 14 above the underlying ground 13 when the legs 11, 12 are pivoted to assume their expanded positions as shown, for example, in FIG. 3.

Leg lock 16 of leg-rigidifier panel 19 is configured to be moved by a user relative to step 14 to cause the first and second legs 11, 12 to move from their retracted positions to their expanded positions during unfolding of step stool 10. As suggested in FIGS. 4-10, first and second legs 11, 12 pivot automatically relative to step 14 to assume their expanded positions shown in response to pivoting movement of leg lock 16 from a retracted position (see FIG. 5) alongside the underside 14U of step 14 to an expanded position (see FIG. 2) arranged to lie in generally perpendicular relation to underside 14U of step 14. The pivoting leg lock 16 applies pivot-inducing forces $F_1$, $F_2$ to the first and second legs 11, 12 as suggested in FIGS. 6-8 to cause legs 11, 12 to pivot to their expanded positions as a user pivots leg lock 16 to its expanded position to unfold step stool 10.

Leg lock 16 of leg-rigidifier panel 19 is configured to lock each of first and second legs 11, 12 in a stationary expanded position relative to step 14 to retain step stool 10 in the expanded use mode once legs 11, 12 are pivoted relative to step 14 from retracted positions shown in FIGS. 1 and 5 to expanded positions shown in FIGS. 2 and 3. In the locked expanded positions, legs 11, 12 cooperate with leg lock 16 to support step 14 in an elevated position above the ground 13 underlying step stool 10 as shown, for example, in FIG. 3. The locking connection established between leg lock 16 and each of legs 11, 12 is accomplished by means of a detent provided on leg lock 16 for positioning and holding leg lock 16 in relation to first leg 11 and to second leg 12 so that the detent can be released and the leg lock 16 can be separated from each of first and second legs 11, 12 when a user desires to fold step stool 10 to assume the compact storage mode by a force applied to one of the parts (e.g., leg lock 16).

First leg 11 is coupled to a first end 141 of step 14 for pivotable movement about a first-end leg pivot axis 11A while second leg 12 is coupled to an opposite second end 142 of step 14 for pivotable movement about a second-end leg pivot axis 12A that is substantially parallel to the first-end leg pivot axis 11A as suggested in FIGS. 2, 5, 7, and 8. Leg lock 16 is mounted to the underside 14U of step 14 for pivotable movement about a leg-lock pivot axis 16A that intersects and lies in substantially perpendicular relation to each of the first-end and second-end leg pivot axes 11A, 12A as suggested in FIGS. 2, 5, 8, and 9.

Figure 10:
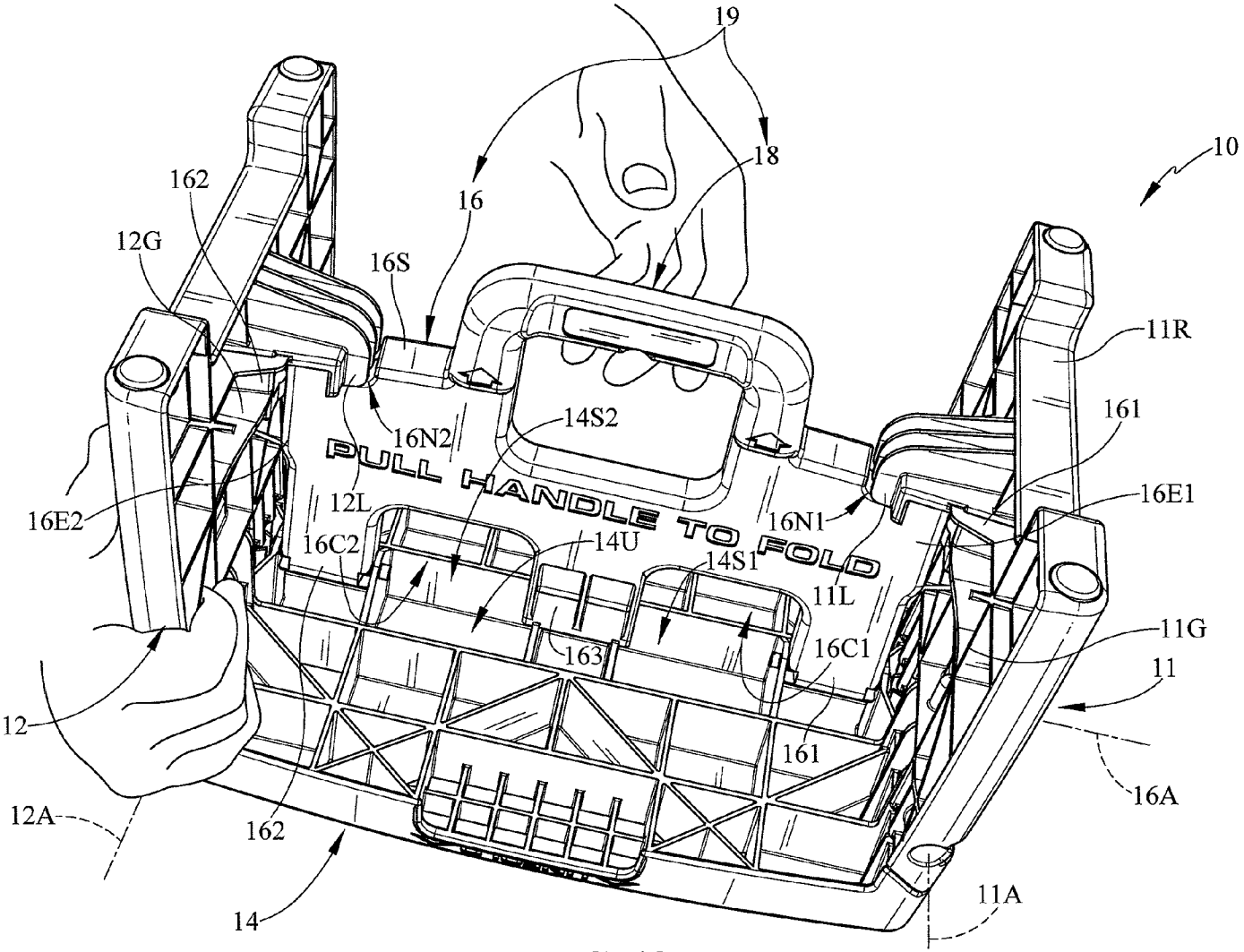
FIG. 10 shows the underside of the step stool now in the expanded use mode and shows formation of a guide in each of the first and second legs and engagement of a first lug of the first retainer arm in a first lug-receiving notch formed in the leg lock along with engagement of a second lug of a second retainer arm of the second leg in a second lug-receiving notch formed in the leg lock and also shows that the lock-mover carry handle of the leg-rigidifier panel is arranged to lie between the first and second lug-receiving notches formed in the leg lock of the leg-rigidifier panel.

Leg lock 16 of leg-rigidifier panel 19 is mounted for pivotable movement about the leg-lock pivot axis 16A by a user between a retracted position shown in FIG. 5 and arranged to lie alongside underside 14U of step 14 and an expanded position shown in FIGS. 2, 3, and 10 and arranged to lie in generally perpendicular relation to step 14. Each of the first and second legs 11, 12 is mounted for pivotable movement about their respective leg axes 11A, 12A between retracted positions arranged to lie in generally spaced-apart parallel relation to underside 14U of step 14 to define a lock-receiver pocket 15 therebetween as suggested in FIG. 1 and expanded positions arranged to lie in generally perpendicular relation to step 14 as suggested in FIG. 2. When step stool 10 has been folded by a user to assume a compact storage mode, the leg lock 16 is retained in the lock-receiver pocket 15 formed between step 14 and the retracted legs 11, 12 as suggested in FIGS. 1 and 4.

Carry handle 18 is coupled to a free side edge 16S of the pivotable leg lock 16 to form leg-rigidifier panel 19 as suggested in FIG. 1. Carry handle 18 is arranged to extend out of the lock-receiver pocket 15 defined between step 14 and first and second legs 11, 12 in the compact storage mode of the step stool 10 as shown in FIGS. 1, 4, and 5 to provide an exposed handgrip for use by a consumer as the consumer carries step stool 10 in the compact storage mode as a briefcase would be carried. A consumer can grasp and pull on carry handle 18 as suggested in FIGS. 5-10 to move leg lock 16 about leg-lock pivot axis 16A to engage and cause first and second legs 11, 12 to pivot so that step stool 10 is changed from the compact storage mode shown in FIGS. 1 and 5 to the expanded use mode shown in FIGS. 3 and 10.

In illustrative embodiments, a slide member 161 or 162 is coupled to each end edge of the pivotable leg lock 16 and arranged to slide in a companion guide 11G or 12G formed in or provided on an inner wall of a neighboring leg 11 or 12 during pivoting movement of leg lock 16 about leg-lock pivot axis 16A from the retracted position to the expanded position as suggested in FIGS. 4-10. During such pivoting movement of leg lock 16, a first slide member 161 coupled to a first end-edge 16E1 of leg lock 16 moves along a first guide 11G formed in or provided on first leg 11 to cause first leg 11 to pivot about first leg-pivot axis 11A away from second leg 12 and move from its retracted position to its expanded position. Simultaneously, a second slide member 162 coupled to a second end-edge 162E2 of leg lock 16 moves along a second guide 12G formed in or provided on second leg 12 to cause second leg 12 to pivot about second leg-pivot axis 12A away from first leg 11 and move from its retracted position to its expanded position so that the first and second legs 11, 12 are arranged to lie generally perpendicular to step 14 and parallel to one another to elevate step 14 when step stool 10 is unfolded by a user to assume an expanded use mode. In illustrative embodiments, guide 11G is arranged to extend inwardly toward carry handle 18 and away from adjacent reinforcing ribs included in first leg 11 as suggested in FIG. 3. Guide 12G is arranged to extend inwardly toward carry handle 18 and away from adjacent reinforcing ribs included in second leg 12 as suggested in FIG. 2.

A first retainer arm 11R is included in first leg 11 and appended to the inner wall of an arm-support panel 11P of first leg 11 and arranged to overlie the underside 14U of step 14 when first leg 11 is pivoted to its expanded position as shown in FIGS. 2 and 10. When each of first leg 11 and leg lock 16 are pivoted to assume their expanded positions, a lug 11L included in the first retainer arm 11R snaps into a lug-receiving notch 16N1 formed on the free side edge 16S of leg lock 16 near carry handle 18 to lock first leg 11 to leg lock 16 so that each of first leg 11 and leg lock 16 is retained in the expanded position. First retainer arm 11R includes a lug-support member 11M cantilevered to arm-support panel 11P and a lug 11L coupled to a free end of lug-support member 11M as shown, for example, in FIGS. 2, 2A, and 3.

Figure 2A:
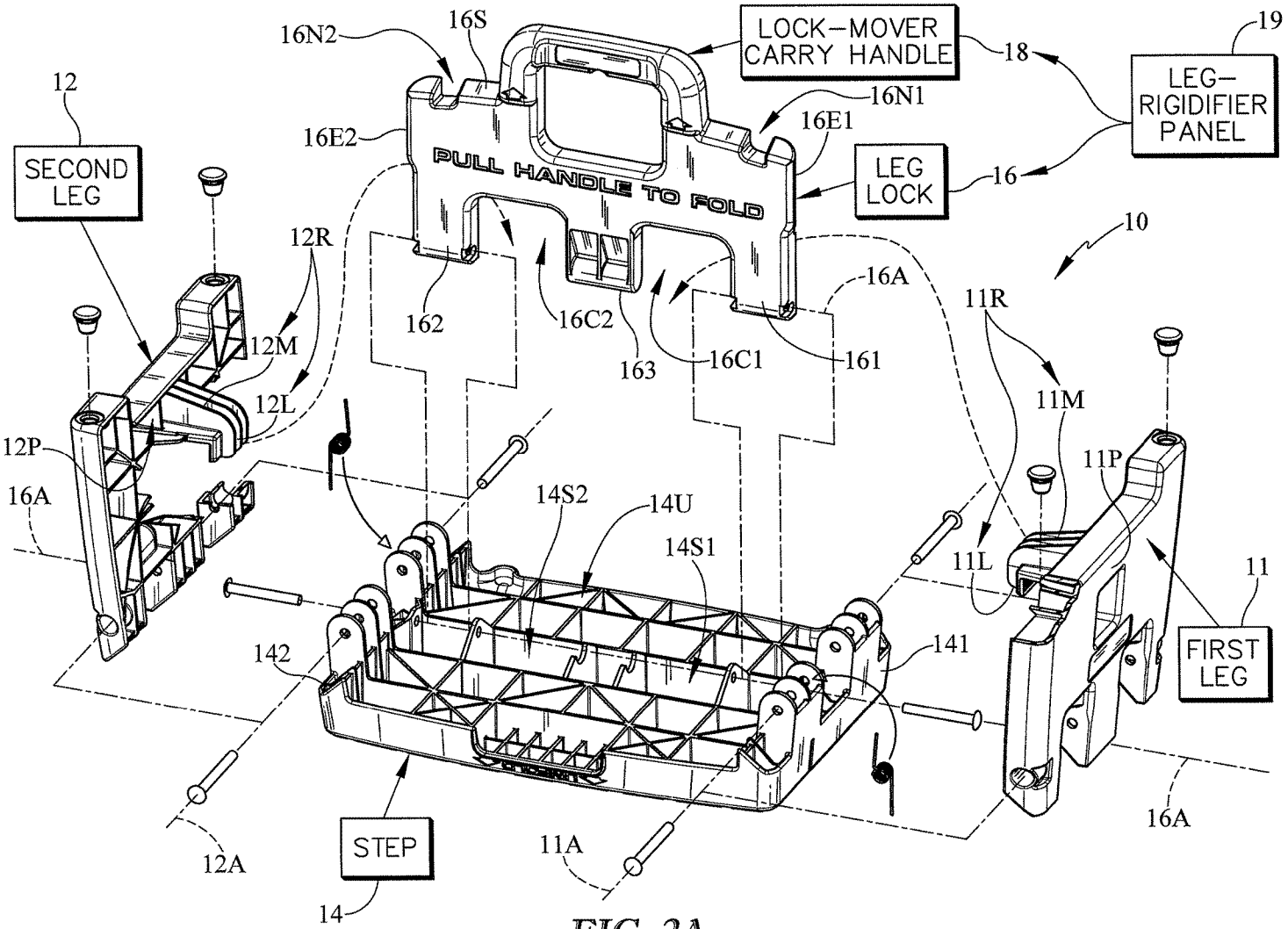
FIG. 2A is an exploded perspective assembly view of the step stool of FIG. 2 showing an inverted step, a pivotable first leg to the right of the step, a pivotable second leg to the left of the step, and a leg-rigidifier panel lying between the first and second legs and comprising a leg lock and a lock-mover carry handle, and showing that an L-shaped first retainer arm cantilevered to an arm-support panel included in the first leg includes a downwardly extending lug sized to snap into a first lug-receiving notch formed in a right shoulder of the leg lock and that an L-shaped second retainer arm cantilevered to an arm-support panel included in the second leg includes a downwardly extending lug sized to snap into a second lug-receiving notch formed in a left shoulder of the leg lock.
Figure 7:
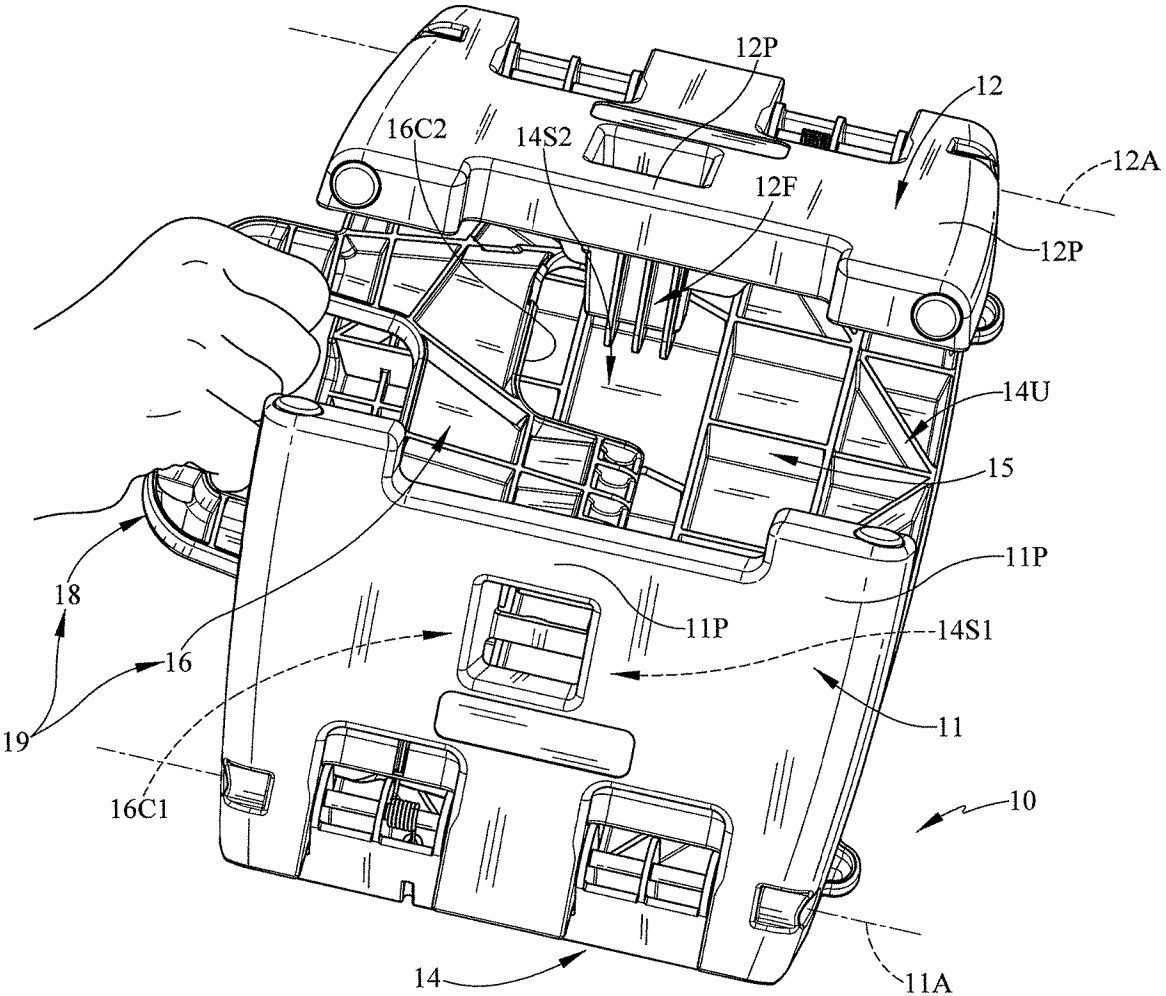
FIG. 7 is another perspective view showing pivoting movement of the first and second legs away from one another in response to pivoting movement of the leg lock and its companion carry handle away from the underside of the step.

A second retainer arm 12R is included in second leg 12 and appended to the inner wall of a panel 12P of second leg 12 and arranged to overlie the underside 14U of step 14 when second leg 12 is pivoted to its expanded position as shown in FIGS. 2A, 3, and 7. When each of second leg 12 and leg lock 16 are pivoted to assume their expanded positions, a lug 12L included in the second retainer arm 12R snaps into a lug-receiving notch 16N2 formed on the free side edge 16S of leg lock 16 near carry handle 18 to lock second leg 12 to leg lock 16 so that each of second leg 12 and leg lock 16 is retained in the expanded position. Second retainer arm 12R includes a leg-support member 12M cantilevered to arm-support panel 12P and a lug 12L coupled to a free end of leg-support member 12M as shown, for example, in FIGS. 2, 2A, and 3.

Figure 9:
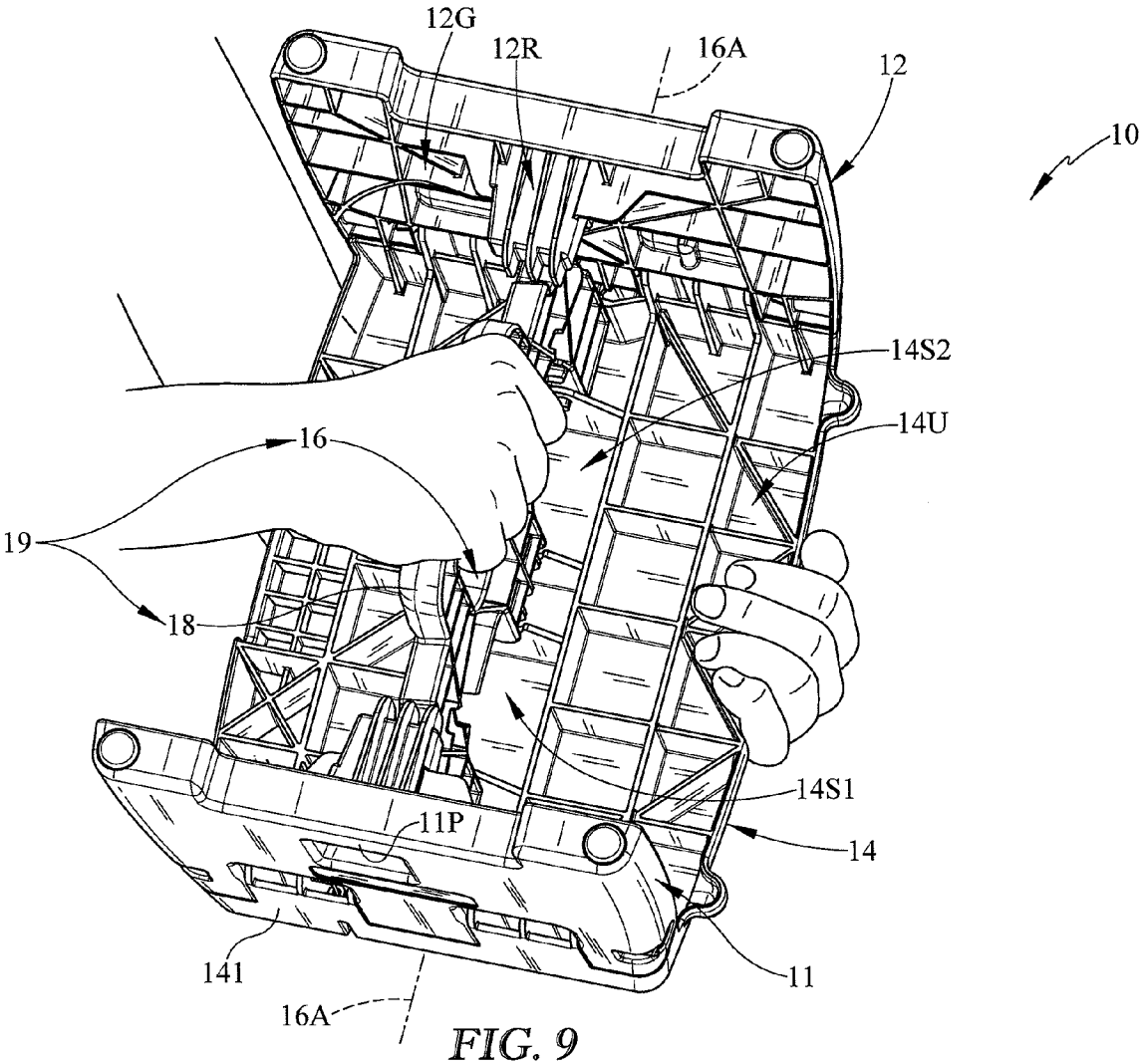
FIG. 9 is a view similar to FIG. 8 showing movement of a lug included in a first retainer arm cantilevered to an arm-support panel included in the first leg into a lug-receiving notch formed in the free side edge of the leg lock.

Step stool 10 includes a step 14 and a step elevator 14E including a first leg 11 coupled to a first end of step 14 for pivotable movement relative to step 14 about a first-end leg pivot axis 11A and a second leg 12 coupled to an opposite second end of step 14 for pivotable movement relative to step 14 about a second-end leg pivot axis 12A as suggested in FIGS. 1-3. Step 10 also includes a leg-rigidifier panel 19 including a leg lock 16 mounted for pivotable movement relative to step 14 about a leg-lock pivot axis 16A from a retracted position arranged to lie alongside an underside 14U of step 14 as shown in FIGS. 1, 4, and 5 to an expanded position arranged to lie in generally perpendicular relation to step 14 as shown in FIGS. 3, 9, and 10. Leg lock 16 is configured to provide means for simultaneously pivoting each of first and second legs 11, 12 about its leg pivot axis 11A or 12A from a retracted position arranged to lie alongside the underside 14U of step 14 to an expanded position arranged to lie in generally perpendicular relation to step 14 to establish an expanded use mode of step stool 10 in response to pivotable movement of leg lock 16 about leg-lock pivot axis 16A from the retracted position to the expanded position as suggested in FIG. 6.

Each of first and second legs 11, 12 is mounted on step 14 for pivotable movement about their respective leg pivot axes 11A or 12A between retracted positions arranged to lie in end-to-end relation to one another and in generally spaced-apart parallel relation to underside 14U of step 14 to define a lock-receiver pocket 15 therebetween as suggested in FIGS. 1 and 5 and expanded positions arranged to lie in generally perpendicular relation to step 14 as suggested in FIG. 3. Leg lock 16 of leg-rigidifier panel 19 is retained in lock-receiver pocket 15 formed between step 14 and first and second legs 11, 12 when step stool 10 has been folded by a user to assume a compact storage mode in which each of the first and second legs 11, 12 and leg lock 16 lies in its retracted position as suggested in FIGS. 1 and 5.

Figure 11:
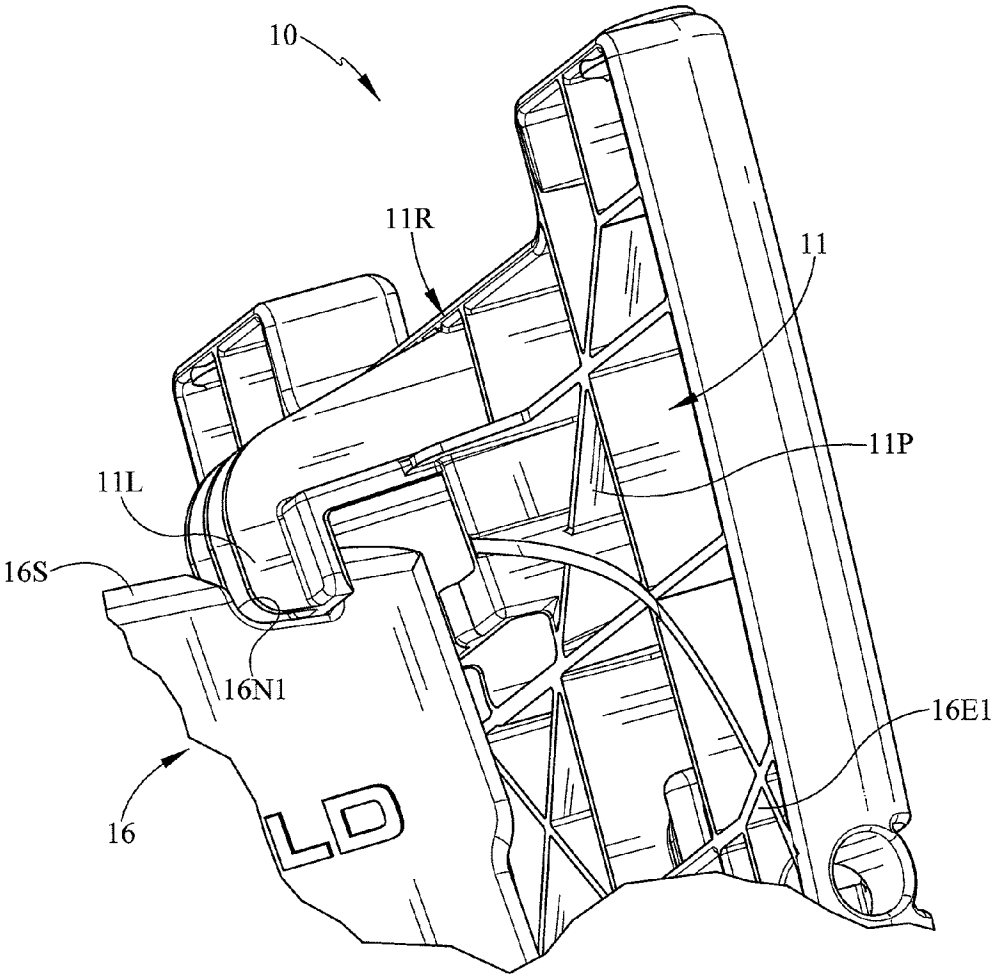
FIG. 11 is an enlarged view of a portion of the first leg and a portion of the leg lock when the step stool is in the expanded use mode showing the first lug included in the first retainer arm extending into the first lug-receiving notch formed in the leg lock.

Leg-rigidifier panel 19 further includes a leg-mover carry handle 18 coupled to leg lock 16 as suggested in FIGS. 2 and 2A and arranged to lie generally outside of lock-receiver pocket 15 when step stool 10 has been folded by a user to assume the compact storage mode as suggested in FIG. 1. Leg-mover carry handle 18 is coupled to a free side edge 16S of leg lock 16 and arranged to extend away from the leg-lock pivot axis 16A as suggested in FIG. 2A. The free side edge 16S of leg lock 16 is formed to receive a first lug-receiving notch 16N1. First leg 11 includes a first lug 11L arranged to extend into the first lug-receiving notch 16N1 when first leg 11 occupies the expanded position to retain leg lock 16 in the expanded position as suggested in FIGS. 2, 10, and 11.

First leg 11 includes a first arm-support panel 11P mounted for pivotable movement about the first-end leg pivot axis 11A and arranged to extend between step 14 and ground 13 underlying step 14 when first leg 11 occupies the expanded position as suggested in FIGS. 2 and 3. First leg 11 further includes a first retainer arm 11R cantilevered to the first arm-support panel 11P to cause a free end thereof to extend into a notch 16N1 formed in the leg lock 16 to retain first leg 11 in the expanded position when leg lock 16 occupies the expanded position as suggested in FIGS. 2, 3, 10, and 11 and to extend through the lock-receiver pocket 15 into a space 14S1 formed in the underside 14U of step 14 when each of the leg lock 16 and the first leg 11 occupies the retracted position as suggested in FIGS. 2 and 7. Similarly, second retainer arm 12R of second leg 12 is arranged to extend through lock-receiver pocket 15 into a space 14S2 also formed in the underside 14U of step 14 when each of the leg lock 16 and the second leg 12 occupies the retracted position as suggested in FIGS. 2 and 7.

First retainer arm 11R includes a lug 11L and a lug-support member 11M arranged to interconnect the first arm-support plate 11P and the lug 11L as suggested in FIGS. 2A and 3. Lug 11L is arranged to extend into a notch 16N1 formed in leg lock 16 when each of the first leg 11 and the leg lock 16 occupy their expanded positions. Lug 11L is arranged to extend into the space 14S1 formed in step 14 when each of the first leg 11 and the leg lock 16 occupy their retracted positions. Lug-support member 11M is arranged to lie in spaced-apart relation to step 14 to locate a portion of the leg lock 16 therebetween when each of the first leg 11 and the leg lock 16 occupy their expanded positions. Lug-support member 11M is arranged to extend through the lock-receiver pocket 15 when each of the first leg 11 and the leg lock 16 occupy their retracted positions.

Figure 8:
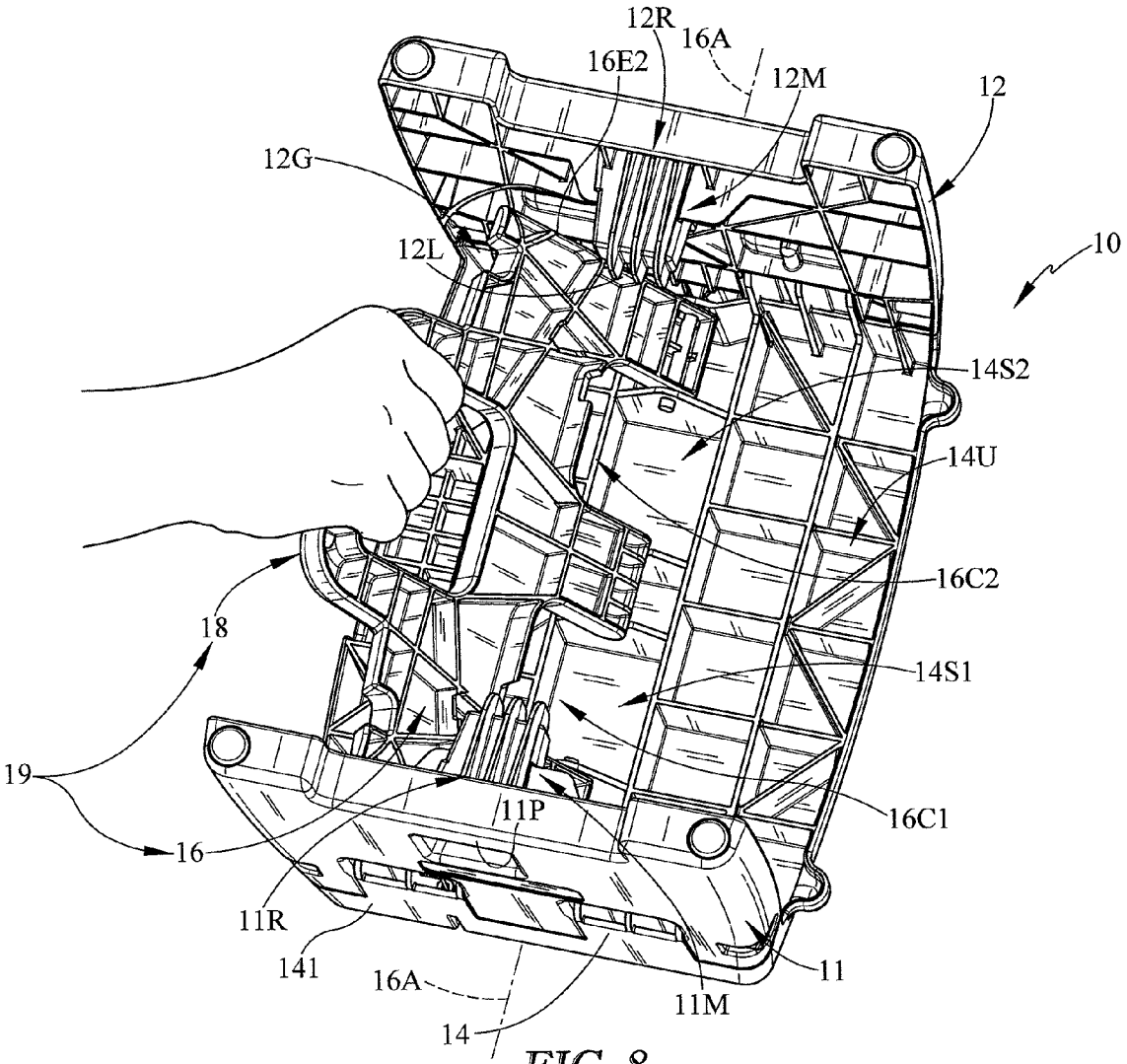
FIG. 8 is another perspective view showing movement of a first slide member included in the leg lock along a curved guide formed in an inner wall of a first panel of the first leg in response to further pivoting movement of the leg lock away from the underside of the step.

Leg lock 16 is formed to include a first arm-receiving channel 16C1 arranged to provide a passageway that extends from the first arm-support panel 11P and the space 14S1 formed in step 14 when each of the first leg 11 and the leg lock 16 occupy their retracted positions as suggested in FIG. 8. First arm-support member 11M is arranged to extend through the first arm-receiving channel 16C1 formed in the leg lock 16 when each of the first leg 11 and the leg lock 16 occupy their retracted positions as suggested in FIG. 2A.

First leg 11 includes a first arm retainer 11R including a lug 11L that extends into a first lug-receiving notch 16N1 formed in the leg lock 16 when each of the first leg 11 and the leg lock 16 occupy their expanded positions to retain each of the first leg 11 and the leg lock 16 in their expanded positions as suggested in FIGS. 2 and 10. First leg 11 further includes an arm-support panel 11P as suggested in FIGS. 2A and 7. First arm retainer 11R further includes a lug-support member 11M cantilevered to the arm-support panel 11P of the first leg 11. Lug 11L of first arm retainer 11R is coupled to a free end of lug-support member 11M and arranged to extend toward step 14 and into the first lug-receiving notch 16N1 formed in leg lock 16 when each of the first leg 11 and the leg lock 16 occupy their expanded positions as suggested in FIG. 2.

Second leg 12 includes a second arm retainer 12R including a lug 12L that extends into a second lug-receiving notch 16N2 formed in leg lock 16 when each of the second leg 12 and the leg lock 16 occupy their expanded positions to retain each of the second leg 12 and the leg lock 16 in their expanded positions as suggested in FIGS. 2 and 10. Second leg 12 further includes an arm-support panel 12P as suggested in FIGS. 2A and 7. Second arm retainer 12R further includes a lug-support member 12M cantilevered to the arm-support panel 12P of the second leg 12. Lug 12L of second arm retainer 12R is coupled to a free end of lug-support member 12M and arranged to extend toward step 14 and into the second lug-receiving notch 16N2 formed in leg lock 16 when each of the second leg 12 and the leg lock 16 occupy their expanded positions as suggested in FIG. 2. First and second lug-support members 11M, 12M are arranged to extend toward one another to locate the carry handle 18 therebetween when each of the first and second legs 11, 12 and the leg lock 16 occupy their expanded positions as suggested in FIG. 2.

First retainer arm 11R is appended to an inner wall of the first arm-support panel 11P as suggested in FIG. 2. First retainer arm 11R is arranged to overlie and lie in spaced-apart relation to an underside 14U of step 14 to cause the lug 11L to the extend into the first lug-receiving notch 16N1 formed in the leg lock 16 when first leg 12 occupies the expanded position.

Leg lock 16 is formed to include a first arm-receiving channel 16C1 opening toward the leg-lock pivot axis 16A as suggested in FIG. 2. First arm retainer 11R has a free end that is arranged to engage the leg lock 16 to retain each of the first leg 11 and the leg lock 16 in their expanded positions when each of the first leg 11 and the leg lock 16 occupy their expanded positions. First arm retainer 11R is arranged to extend through the first arm-receiver channel 16C1 formed in the leg lock 16 when each of the first leg 11 and the leg lock 16 occupy their retracted positions. First arm-support member 11M of first arm retainer 11R is arranged to extend through the first arm-receiving channel 16C1 formed in the leg lock 16 when each of the first leg 11 and leg lock 16 occupy their retracted positions.

Leg lock 16 is formed to include a second arm-receiving channel 16C2 opening toward the leg-lock pivot axis 16A as suggested in FIG. 2. Second leg 12 includes a second arm retainer 12R that has a free end that is arranged to engage leg lock 16 to retain each of the second leg 12 and the leg lock 16 in their expanded positions when each of the second leg 12 and the leg lock 16 occupy their expanded positions. Second arm retainer 12R is arranged to extend through the second arm-receiver channel 16C2 formed in leg lock 16 when each of the second leg 12 and the leg lock 16 occupy their retracted positions. Second arm-support member 12M is arranged to extend through the second arm-receiving channel 16C2 formed in leg lock 16 when each of the second leg 12 and leg lock 16 occupy their retracted positions.

Leg lock 16 includes first, second, and center posts 161, 162, 163 as shown, for example, in FIG. 2A. First post 161 is pivotably coupled to step 14 along the leg-lock pivot axis 16A and arranged to lie adjacent to the first leg 11 when first leg 11 and leg lock 16 occupy their expanded positions. Second post 162 is pivotably coupled to step 14 along the leg-lock pivot axis 164 and arranged to lie adjacent to the second leg 12 when the second leg 12 and the leg lock 16 occupy their expanded positions. Center post 163 is pivotably coupled to step 14 along leg-lock pivot axis 16A. Center post 163 is arranged to lie in spaced-apart relation to the first post 161 to form the first arm-receiving channel 16C1 therebetween and in spaced-apart relation to the second post 162 to form the second arm-receiving channel 16C2 therebetween as suggested in FIG. 2.

Leg lock 16 further includes a carry-handle support 164 coupled to each of the first, center, and second posts 161-163 and formed to include a first lug-receiving notch 16N1 and a second lug-receiving notch 16N2 as suggested in FIG. 2A. First arm retainer 11R includes a lug 11L arranged to extend into the first lug-receiving notch 16N1 formed in the carry-handle support 164 of leg lock 16 when each of the first leg 11 and leg lock 16 occupy their expanded positions to retain each of the first leg 11 and the leg lock 16 in their expanded positions. Leg-rigidifier panel 19 further includes a carry handle 18 coupled to the carry-handle support 164 of the leg lock 16 and arranged to extend away from step 14 and first and second legs 11, 12 when leg lock 16 and the first and second legs 11, 12 occupy their retracted positions as suggested in FIG. 1.

The invention claimed is:

1. A folding step stool comprise a step, a step elevator including a first leg coupled to a first end of the step for pivotable movement relative to the step about a first-end leg pivot axis and a second leg coupled to an opposite second end of the step for pivotable movement relative to the step about a second-end leg pivot axis, and a leg-rigidifier panel including a leg lock mounted for pivotable movement relative to the step about a leg-lock pivot axis from a retracted position arranged to lie alongside an underside of the step to an expanded position arranged to lie in generally perpendicular relation to the step, the leg lock being configured to provide means for simultaneously pivoting each of the first and second legs about its leg pivot axis from a retracted position arranged to lie alongside the underside of the step to an expanded position arranged to lie in generally perpendicular relation to the step to establish an expanded use mode of the step stool in response to pivotable movement of the leg lock about the leg-lock pivot axis from the retracted position to the expanded position.

2. The folding step stool of claim 1, whenever each of the first and second legs is mounted on the step for pivotable movement about their respective leg pivot axes between retracted positions arranged to lie in end-to-end relation to one another and in generally spaced-apart parallel relation to the underside of the step to define a lock-receiver pocket therebetween and expanded positions arranged to lie in generally perpendicular relation to the step and wherein the leg lock of the leg-rigidifier panel is retained in the lock-receiver pocket formed between the step and the first and second legs when the step stool has been folded by a user to assume a compact storage mode in which each of the first and second legs and the leg lock lies in its retracted position.

3. The folding step stool of claim 2, wherein the leg-rigidifier panel further includes a leg-mover carry handle coupled to the leg lock and arranged to lie generally outside of the lock-receiver pocket when the step stool has been folded by a user to assume the compact storage mode.

4. The folding step stool of claim 3, wherein the leg-mover carry handle is coupled to a free side edge of the leg lock and arranged to extend away from the leg-lock pivot axis.

5. The folding step stool of claim 4, wherein a first lug-receiving notch is formed in the free side edge of the leg lock and the first leg includes a first lug arranged to extend into the first lug-receiving notch when the first leg occupies the expanded position to retain the leg lock in the expanded position.

6. The folding step stool of claim 2, wherein the first leg includes a first arm-support panel mounted for pivotable movement about the first-end leg pivot axis and arranged to extend between the step and ground underlying the step when the first leg occupies the expanded position and the first leg further includes a first retainer arm cantilevered to the first arm-support panel to cause a free end thereof to extend into a notch formed in the leg lock to retain the first leg in the expanded position when the leg lock occupies the expanded position and to extend through the lock-receiver pocket into a space formed in the step when each of the leg lock and the first leg occupies the retracted position.

7. The folding step stool of claim 6, wherein the first retainer arm includes a lug and a lug-support member arranged to interconnect the first arm-support panel and the lug, the lug is arranged to extend into the notch formed in the leg lock when each of the first leg and the leg lock occupy their expanded positions, the lug is arranged to extend into the space formed in the step when each of the first leg and the leg lock occupy their retracted positions, the lug-support member is arranged to lie in spaced-apart relation to the step to locate a portion of the leg lock therebetween when each of the first leg and the leg lock occupy their expanded positions, and the lug-support member is arranged to extend through the lock-receiver pocket when each of the first leg and the leg lock occupy their retracted positions.

8. The folding step stool of claim 7, wherein the leg lock is formed to include a first arm-receiving channel arranged to provide a passageway that extends from the first arm-support panel and the space formed in the step when each of the first leg and the leg lock occupy their retracted positions and the first arm-support member is arranged to extend through the first arm-receiving channel formed in the leg lock when each of the first leg and the leg lock occupy their retracted positions.

9. The folding step stool of claim 1, wherein the first leg includes a first arm retainer including a lug that extends into a first lug-receiving notch formed in the leg lock when each of the first leg and the leg lock occupy their expanded positions to retain each of the first leg and the leg lock in their expanded positions.

10. The folding step stool of claim 9, wherein the first leg further includes an arm-support panel and the first arm retainer further includes a lug-support member cantilevered to the arm-support panel of the first leg, the lug of the first arm retainer is coupled to a free end of the lug-support member and arranged to extend toward the step and into the first lug-receiving notch formed in the leg lock when each of the first leg and the leg lock occupy their expanded positions.

11. The folding step stool of claim 10, wherein the second leg includes a second arm retainer including a lug that extends into a second lug-receiving notch formed in the leg lock when each of the second leg and the leg lock occupy their expanded positions to retain each of the second leg and the leg lock in their expanded positions, the second leg further includes an arm-support panel, the second arm retainer further includes a lug-support member cantilevered to the arm-support panel of the second leg, and the lug of the second arm retainer is coupled to a free end of the lug-support member and arranged to extend toward the step and into the second lug-receiving notch formed in the leg lock when each of the second leg and the leg lock occupy their expanded positions.

12. The folding step stool of claim 11, wherein the first and second lug-support members are arranged to extend toward one another to locate a carry handle therebetween when each of the first and second legs and the leg lock occupy their expanded positions.

13. The folding step stool of claim 10, wherein the first retainer arm is appended to an inner wall of the first arm-support panel and arranged to overlie and lie in spaced-apart relation to an underside of the step to cause the lug to the extend into the first lug-receiving notch formed in the leg lock when first leg occupies the expanded position.

14. The folding step stool of claim 1, wherein the leg lock is formed to include a first arm-receiving channel opening toward the leg-lock pivot axis, the first leg includes a first arm retainer that has a free end that is arranged to engage the leg lock to retain each of the first leg and the leg lock in their expanded positions when each of the first leg and the leg lock occupy their expanded positions, and the first arm retainer is arranged to extend through the first arm-receiver channel formed in the leg lock when each of the first leg and the leg lock occupy their retracted positions.

15. The folding step stool of claim 14, wherein the first leg includes the first arm retainer including a lug that extends into a first lug-receiving notch formed in the leg lock when each of the first leg and the leg lock occupy their expanded positions to retain each of the first leg and the leg lock in their expanded positions, the first leg further includes an arm-support panel, the first arm retainer further includes a lug-support member cantilevered to the arm-support panel of the first leg, the lug of the first arm retainer is coupled to a free end of the lug-support member and arranged to extend toward the step and into the first lug-receiving notch formed in the leg lock when each of the first leg and the leg lock occupy their expanded positions, and the first arm-support member is arranged to extend through the first arm-receiving channel formed in the leg lock when each of the first leg and leg lock occupy their retracted positions.

16. The folding step stool of claim 14, wherein the leg lock is formed to include a second arm-receiving channel opening toward the leg-lock pivot axis, the second leg includes a second arm retainer that has a free end that is arranged to engage the leg lock to retain each of the second leg and the leg lock in their expanded positions when each of the second leg and the leg lock occupy their expanded positions, and the second arm retainer is arranged to extend through the second arm-receiver channel formed in the leg lock when each of the second leg and the leg lock occupy their retracted positions.

17. The folding step stool of claim 16, wherein the leg lock includes a first post pivotably coupled to the step along the leg-lock pivot axis and arranged to lie adjacent to the first leg when the first leg and the leg lock occupy their expanded positions, a second post pivotably coupled to the step along the leg-lock pivot axis and arranged to lie adjacent to the second leg when the second leg and the leg lock occupy their expanded positions, and a center post pivotably coupled to the step along the leg-lock pivot axis, and the center post is arranged to lie in spaced-apart relation to the first post to form the first arm-receiving channel therebetween and in spaced-apart relation to the second post to form the second arm-receiving channel therebetween.

18. The folding step stool of claim 17, wherein the first leg includes the first arm retainer including a lug that extends into a first lug-receiving notch formed in the leg lock when each of the first leg and the leg lock occupy their expanded positions to retain each of the first leg and the leg lock in their expanded positions, the first leg further includes an arm-support panel, the first arm retainer further includes a lug-support member cantilevered to the arm-support panel of the first leg, the lug of the first arm retainer is coupled to a free end of the lug-support member and arranged to extend toward the step and into the first lug-receiving notch formed in the leg lock when each of the first leg and the leg lock occupy their expanded positions, the first arm-support member is arranged to extend through the first arm-receiving channel formed in the leg lock when each of the first leg and leg lock occupy their retracted positions, the second leg includes a second arm retainer including a lug that extends into a second lug-receiving notch formed in the leg lock when each of the second leg and the leg lock occupy their expanded positions to retain each of the second leg and the leg lock in their expanded positions, the second leg further includes an arm-support panel, the second arm retainer further includes a lug-support member cantilevered to the arm-support panel of the second leg, the lug of the second arm retainer is coupled to a free end of the lug-support member and arranged to extend toward the step and into the second lug-receiving notch formed in the leg lock when each of the second leg and the leg lock occupy their expanded positions, and the second arm-support member is arranged to extend through the second arm-receiving channel formed in the leg lock when each of the second leg and leg lock occupy their retracted positions.

19. The folding step stool of claim 17, wherein the leg lock further includes a carry-handle support coupled to each of the first, center, and second posts and formed to include a first lug-receiving notch, the first arm retainer includes a lug arranged to extend into the first lug-receiving notch formed in the cam-handle support of the leg lock when each of the first leg and leg lock occupy their expanded positions to retain each of the first leg and the leg lock in their expanded positions, and the leg-rigidifier panel further includes a carry handle coupled to the carry-handle support of the leg lock and arranged to extend away from the step and the first and second legs when the leg lock and the first and second legs occupy their retracted positions.

* * * * *